United States Patent [19]

Okazaki et al.

[11] Patent Number: 4,917,053

[45] Date of Patent: Apr. 17, 1990

[54] FUEL SUPPLYING SYSTEM FOR PLURAL-CYLINDER INTERNAL COMBUSTION ENGINE

[75] Inventors: Masaki Okazaki; Junichi Hasegawa; Hiroaki Fujimoto, all of Hamamatsu, Japan

[73] Assignee: Sanshin Kogyo Kabushiki Kaisha, Hamamatsu, Japan

[21] Appl. No.: 345,614

[22] Filed: Apr. 27, 1989

[30] Foreign Application Priority Data

Apr. 28, 1989 [JP] Japan ..... 64-105608

[51] Int. Cl.[4] ..... F02M 35/10

[52] U.S. Cl. ..... 123/52 MB; 123/73 A

[58] Field of Search ..... 123/52 M, 52 MB, 73 A, 123/73 B, 73 C, 73 V, 52 MC

[56] References Cited

U.S. PATENT DOCUMENTS

| | | | |
|---|---|---|---|
| 3,453,994 | 7/1969 | Nutten et al. | 123/73 R |
| 3,730,160 | 5/1973 | Hughes | 123/52 M |
| 3,800,753 | 4/1974 | Sullivan et al. | 123/73 A |
| 4,244,332 | 1/1981 | Kusche et al. | 123/52 MV |
| 4,345,551 | 8/1982 | Bloemers | 123/52 M |
| 4,462,346 | 7/1984 | Haman et al. | 123/73 A |
| 4,776,313 | 10/1988 | Freismuth et al. | 123/468 |
| 4,815,427 | 3/1989 | Radtke | 123/52 MB |

FOREIGN PATENT DOCUMENTS

| | | | |
|---|---|---|---|
| 2758492 | 7/1978 | Fed. Rep. of Germany | 123/73 A |
| 60-198362 | 10/1985 | Japan . | |

*Primary Examiner*—David A. Okonsky

*Attorney, Agent, or Firm*—Ernest A. Beutler

[57] ABSTRACT

Several embodiments of enrichment system for internal combustion engines for supplying enrichment fuel in response to a predetermined condition. In each embodiment, the engine has multiple chambers with multiple intake passages and a balance passage that interconnects at least some of the intake passages. The supplemental fuel is delivered to the balance passage for distribution to the chambers served by the interconnected intake passages. In some embodiments, the engine is provided with a charge forming system in the form of carburetors and in other embodiments, the engine is provided with a charge forming system in the form of fuel injection.

18 Claims, 5 Drawing Sheets

Figure 4
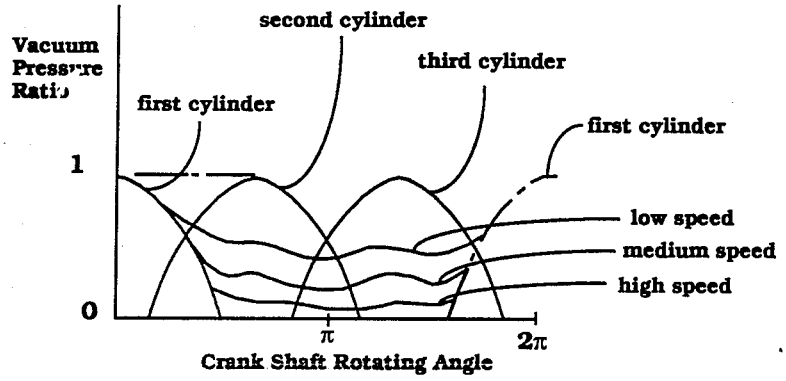
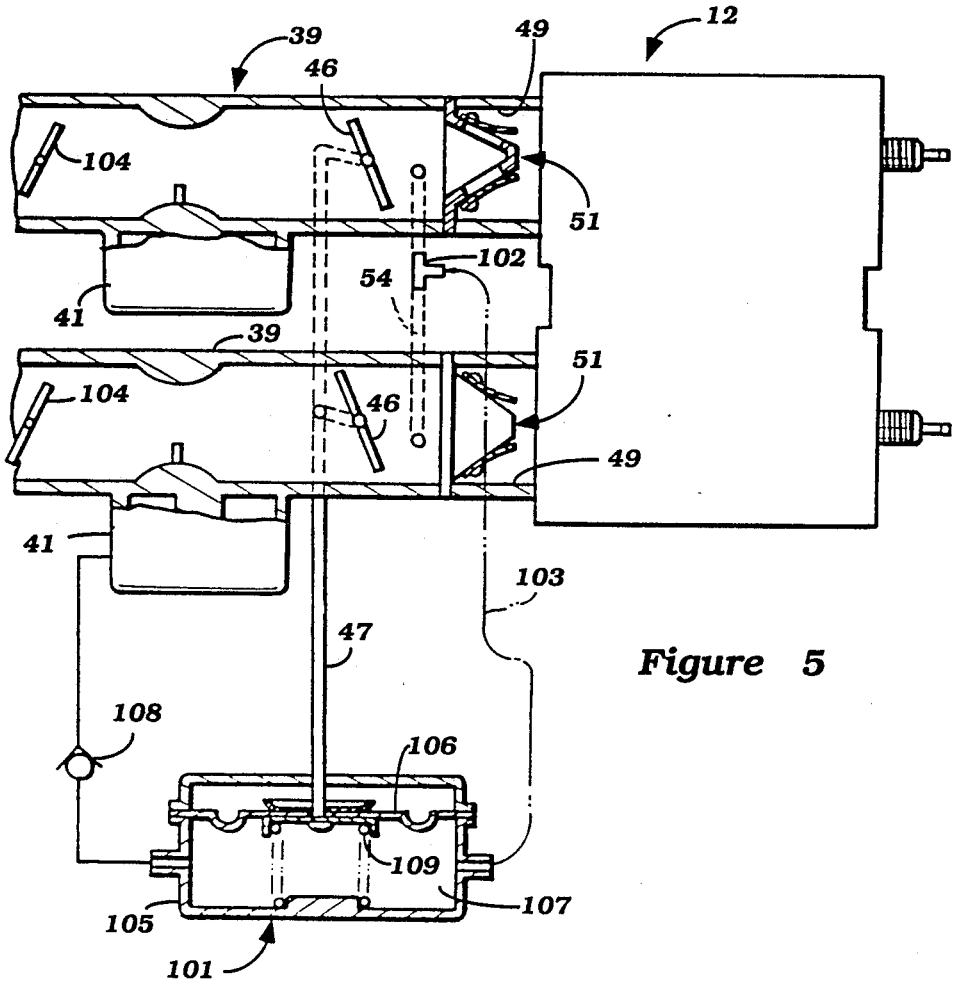
Figure 5

FUEL SUPPLYING SYSTEM FOR PLURAL-CYLINDER INTERNAL COMBUSTION ENGINE

BACKGROUND OF THE INVENTION

This invention relates to a fuel supplying system for plural-cylinder internal combustion engines and more particularly to an improved and simplified arrangement for providing enrichment fuel to a multi-cylinder engine.

In many forms of engines, in addition to the normal fuel supplying system for the engine, there is provided an enrichment system for supplying additional fuel in response to certain specific conditions such as a running condition of the engine, like acceleration, or an ambient condition, such as temperature for cold starting. Many times, this enrichment system is generally separate from the normal charge forming system for the engine. That is, the engine may be provided with either a carburetor or a fuel injection system that provides the bulk of the fuel requirements for the engine. However, a separate enrichment system is incorporated for supplying the enrichment fuel. For example, with two-cycle internal combustion engines, it is common to provide these separate enrichment systems to supply fuel for acceleration, anti-knock purposes, cold starting or cold running. Although the fuel for the enrichment system may be drawn from the same source as supplies the main charge former, frequently the fuel is introduced into a different place in the engine's induction system.

Where the engine has plural cylinders, it has been the practice to provide the enrichment fuel in the manifold system for the cylinders. Therefore, it obviously is necessary to provide considerable piping for delivering fuel to each of the manifold passages that are supplied with enrichment fuel. Frequently, there supply conduits are external to the engine and this can give rise to a number of disadvantages.

It is, therefore, a principal object of this invention to provide an improved and simplified fuel enrichment arrangement for a multiple cylinder internal combustion engine.

It is a yet further object of this invention to provide an enrichment system for a multiple cylinder internal combustion engine that is simple and which yet insures that equal fuel will be delivered to all of the induction passages served.

SUMMARY OF THE INVENTION

A first feature of this invention is adapted to be embodied in a fuel enrichment system for a multi-chamber internal combustion engine that is comprised of a first intake passage for supplying a charge to a first of the chambers. A second intake passage is provided for supplying a charge to a second of the chambers and charge forming means supply a fuel/air charge to the intake passages. Balance passage means communicate the first and second intake passages with each other and means are provided for introducing supplemental fuel to the balance passage means in response to a predetermined condition.

Another feature of the invention is also adapted to be embodied in a fuel enrichment for a multi-chamber engine. In accordance with this feature of the invention, a first member is formed with a plurality of separate intake passages, each extending to a respective one of the engine chambers. The first member has a face through which the intake passages open. A second member is affixed to the first member in contact with the face and has a plurality of passages, each of which communicated with a respective one of the first member intake passages. A balance conduit is formed by the second member for communicating at least two of its passages with each other. Means are provided for introducing fuel to the balance passage of the second member.

BRIEF DESCRIPTION OF THE DRAWINGS

FIG. 4 is a graphical analysis showing the vacuum pressure ratio within the intake passages relative to crank angle with and without the balance passages to show the effect of the balance passages in this embodiment.

FIG. 5 is a partial side elevational view, with a portion broken away, of an internal combustion engine constructed in accordance with another embodiment of the invention.

DETAILED DESCRIPTION OF THE PREFERRED EMBODIMENTS

Figure 1:
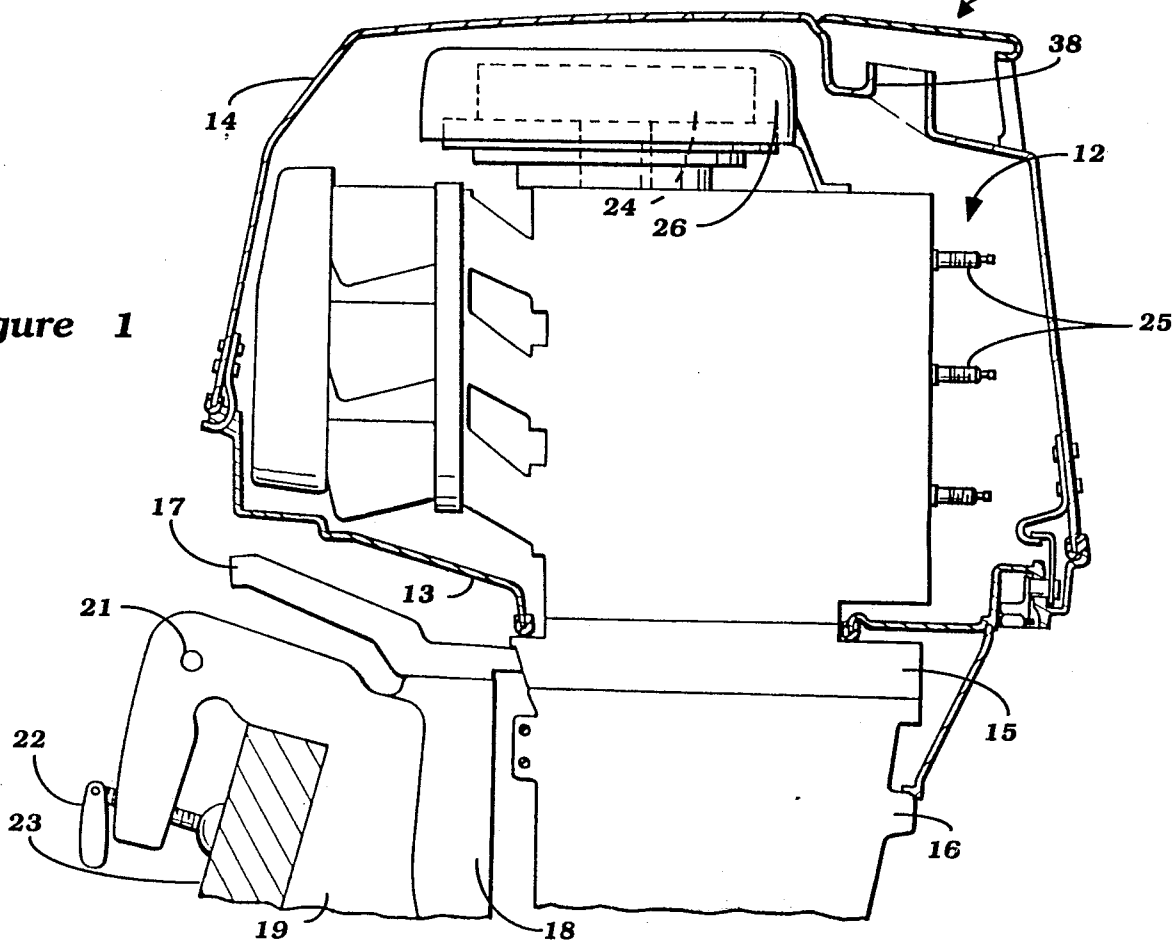
FIG. 1 is a partial side elevational view of an outboard motor as attached to the transom of a watercraft showing an environment in which the invention can be practiced.

Referring first to FIG. 1, an outboard motor constructed in accordance with an embodiment of the invention is identified generally by the reference numeral 11. The invention is described in conjunction with an outboard motor because the illustrated embodiments all deal with two-cycle crankcase compression engines and such engines are typically employed with outboard motors. It is to be understood, however, that the invention can be utilized in conjunctions with engines used for other purposes and also in conjunction with engines other than those operating on the two cycle principle.

The outboard motor 11 includes a power head that is comprised of an internal combustion engine 12 that is surrounded by a protective cowling comprised of a lower tray 13 and a main cover portion 14 that is detachably connected to the tray 13 in a known manner.

As will become apparent in the description of the remaining figures, the engine 12 is supported so that its output shaft rotates about a vertically extending axis and the engine 12 is affixed to the upper side of a spacer place 15. A drive shaft driven by the engine output shaft extends through the spacer plate 15 and into a drive shaft housing 16 that is affixed to the underside of the spacer plate 15. This drive shaft extends to a lower unit (not shown) so as to drive a propeller or other form of propulsion device in a known manner.

The outboard motor 11 further includes a steering shaft (not shown) having a steering tiller 17 affixed to its upper end. This steering shaft is journaled for steering movement within a swivel bracket 18 for steering of the outboard motor 11 in a known manner. The swivel bracket 18 is pivotally connected to a clamping bracket 19 by means of horizontally extending pivot pin 21 for tilt and trim adjustment of the outboard motor. A clamping device 22 is carried by the clamping bracket 19 for attachment of the outboard motor 11 to a transom 23 of an associated watercraft which is only shown partially.

A flywheel magneto 24 is affixed to the upper end of the engine output shaft and fires a series of spark plugs 25, one for each cylinder, by means of a suitable ignition system. The flywheel magneto 24 is covered by a cover plate 26 that is affixed to the cylinder block of the engine.

Figure 2:
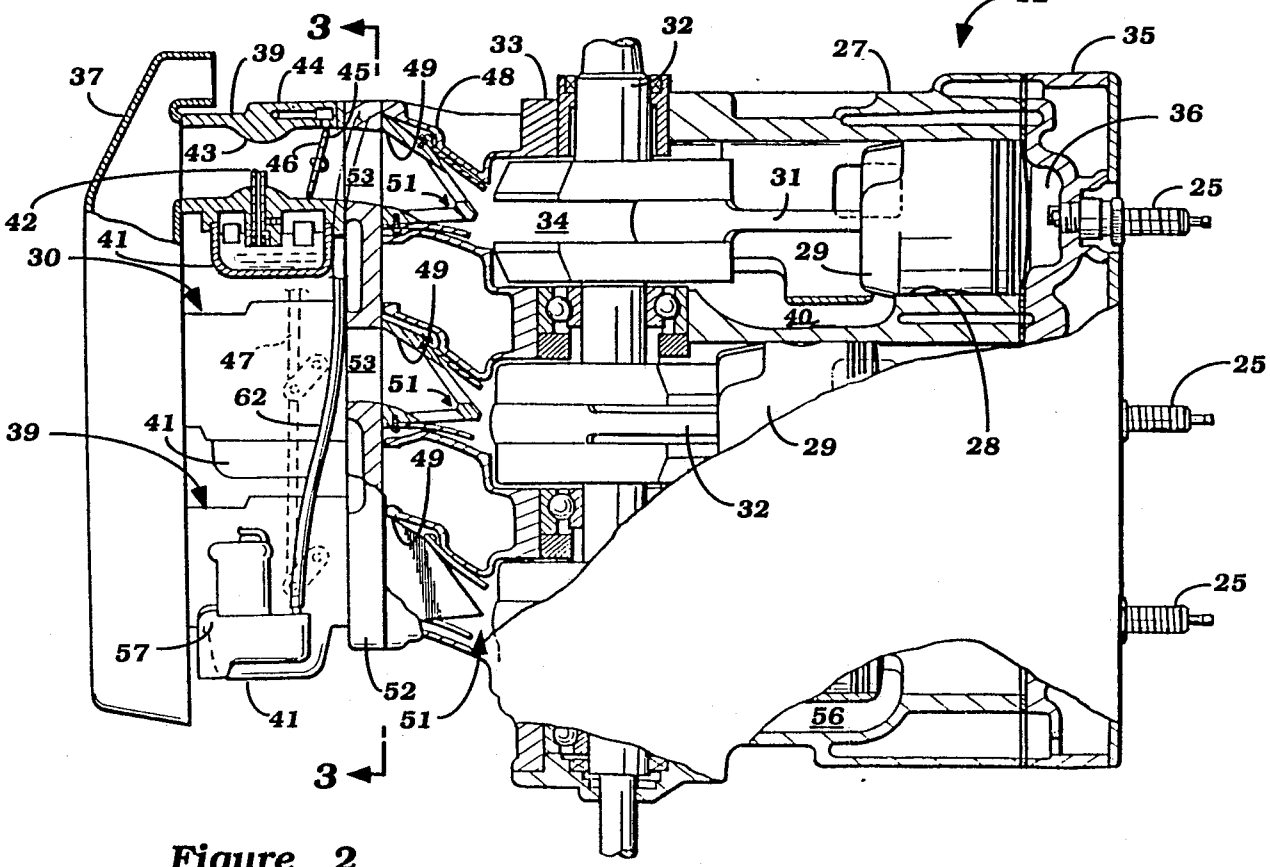
FIG. 2 is an enlarged view of the engine of the outboard motor, with portions broken away and shown in section.
Figure 3:
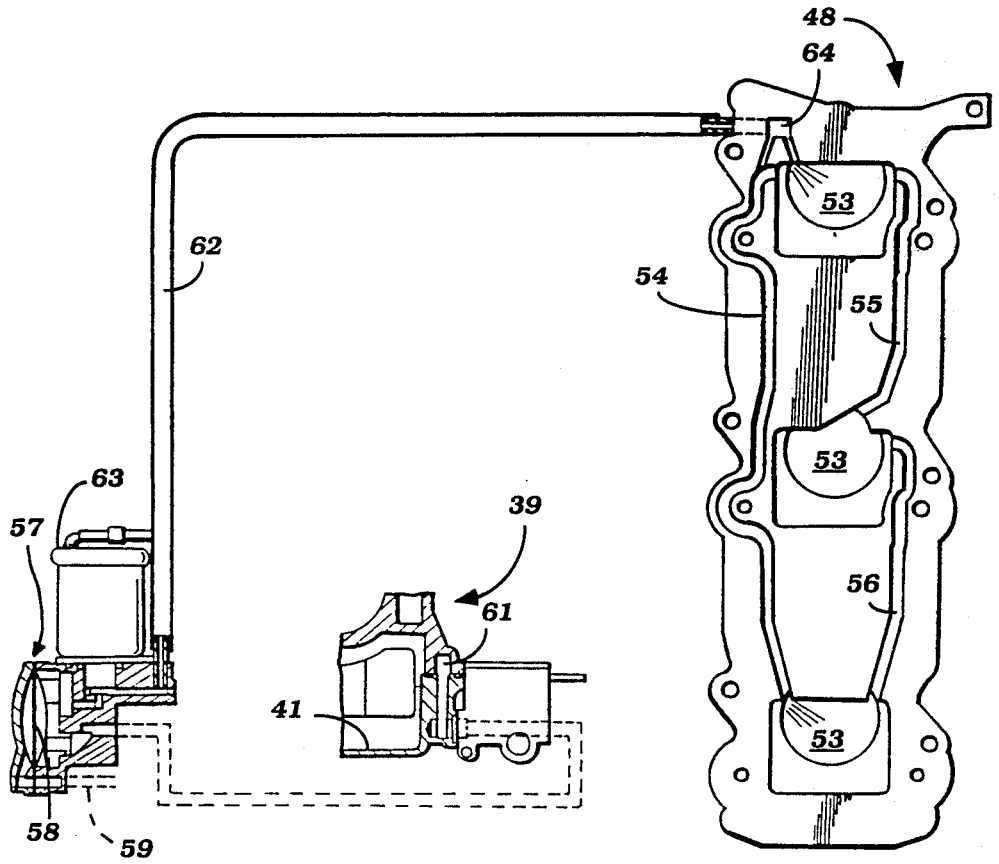
FIG. 3 is a partially schematic cross-sectional view taken along the line 3—3 of FIG. 2.

Referring now primarily to FIGS. 2 and 3, it will be seen that the engine 12 is comprised of a cylinder block 27 in which a plurality of cylinder bores 28 are formed. In the illustrated embodiment, the engine 12 is of the three cylinder, inline type although the invention can be utilized in conjunction with engines having other than three cylinders. However, the invention has particular utility in conjunction with engines that have multiple chambers such as multiple cylinders in the case of a reciprocating engine.

Pistons 29 are supported for reciprocation within each of the cylinder bores 28 and are connected by means of connecting rods 31 to a crankshaft 32. The crankshaft 32 is rotatably journaled between the cylinder block 27 and a crankcase 33 about a vertically extending axis as aforenoted. As is conventional with two-cycle internal combustion engines, the crankcase 32 forms a plurality of crankcase chambers 34, each associated with a respective of the cylinder bores 28 with the crankcase chambers 34 being sealed from each other in a suitable manner.

A cylinder head 35 is affixed to the cylinder block 27 in a known manner and defines individual recesses 36 which cooperate with the pistons 29 and cylinder bores 28 to provide chambers which vary in volume as the pistons 29 reciprocate. These chambers 36 may be referred to as the combustion chambers.

A charge forming system is provided for delivering a fuel/air charge to each of the individual crankcase chambers 34. The charge is compressed in the crankcase chambers 34 and delivered to the combustion chambers 36 through scavenge passages 40. In this embodiment, this charge forming system includes an air inlet device 37 that draws atmospheric air from the area within the protective cowling of the outboard motor. Air is admitted to this internal chamber through a suitable external air inlet such as the inlet 38 shown in FIG. 1.

The air inlet device 37 supplies air to a plurality of carburetors, each of which is indicated by the reference numeral 39. Each carburetor 39 is comprised of a fuel bowl 41 to which fuel is supplied by means of an appropriate fuel supply system and in which fuel is maintained at a level head by means of a float operated valve. A main fuel discharge nozzle 42 extends from the fuel bowl 41 into a venturi section 43 of the carburetors 39.

Each carburetor 39 further includes an idle fuel discharge system that is supplied from the fuel bowl 41 in a known manner that includes a passageway 44 and discharge port 45. The discharge ports 45 are located in proximity to throttle valves 46 that are positioned downstream of the venturi sections 43 and which control the flow of fuel/air mixture supplied to the engine in a known manner. The throttle valves 46 are all linked together by means of a linkage system 47 so that their movement will be synchronized.

In conventional engine practice, the carburetors 39 communicate directly with an intake manifold, indicated generally by the reference number 48 and which has a plurality of individual intake passages 49, each of which serves a respective one of the crankcase chambers 34. Reed type check valves 51 are positioned in each of the manifold passages 49 so as to preclude reverse flow through the manifold passages 49.

In accordance with the invention, however, a spacer plate 52 is interposed between the carburetors 39 and the manifold 48. The spacer plate 52 has individual passageways 53 that provide communication between the carburetor flow passages and the manifold passages 49. Furthermore, and as best seen in FIG. 3, the spacer plate 52 is formed with a plurality of balance passages 54, 55 and 56 that communicate the passages 53 with each other. The balance passages 54, 55 and 56 tend to dampen the variations in vacuum pressure ratio within the intake passages 53 and those passages 49 of the manifold as may be best seen in FIG. 4. As seen in this figure, the curves identified first cylinder, second cylinder and third cylinder, indicate the variation in pressure that occurs during the reciprocation of the engine and at such times when an intake charge is being delivered into the crankcase. As will be seen by the lines labeled low speed, medium and high speed, the balance passageways 54, 55 and 56 tend to reduce to some extent these pressure variations and accordingly improve engine performance and smoothness.

In accordance with the invention, supplemental fuel for certain running or ambient conditions is supplied to the balance passages or certain of them in order to respond to a predetermined condition. In this particular embodiment, the supplemental fuel is supplied so as to assist cold starting and/or cold running.

A supplemental fuel enrichment device, indicated generally by the reference numeral 57, is provided for this purpose. The enrichment device 57 includes a diaphragm type pump 58 that is actuated by pressure variations in one of the crankcase chambers through a conduit, shown schematically at 59. Fuel is delivered to the pump 58 from a well 61 formed in one of the carburetor bodies and which receives fuel from its fuel bowl 41. This fuel may be delivered through a discharge conduit 62, which is positioned externally of the engine, when the ambient temperature or the engine temperature is low. This fuel flow is controlled by means of a temperature responsive fuel control valve 63 which may be of the wax pellet type and which includes a heating coil that is heated when the flywheel magneto 24 rotates. As a result, when the engine is first started and the ambient temperature is low, the fuel control valve 63 will be opened and starting fuel will be delivered. However, as the engine runs, the wax pellet will be heated and in time the control valve 63 will shut off the flow of this supplemental fuel.

The fuel is delivered to the chambers of the engine through an internal passageway 64 that is formed in the spacer plate 48 and which communicates with at least one of the balance passageways, in this embodiment the passageway 54. In addition, the delivery passage 64 may feed directly to one of the passageways 53 of the spacer plate 48. However, since the fuel is delivered primarily to the balance passageway, the number of external pipes is reduced to one regardless of the number of cylinders or passageways served.

FIG. 5 shows another embodiment of the invention which is, insofar as the construction of the basic engine is concerned, the same as the embodiment of FIGS. 2 and 3. For that reason, those components of this embodiment that are the same as the previously described embodiment have been identified by the same reference numerals and will not be described again in detail. In this embodiment, the engine 12 is depicted as being of the two-cylinder inline type and, hence, only a single balance passageway 54 is provided between the two intake passages. As previously noted, however, the invention can be utilized in conjunction with engines having other cylinder numbers or other numbers of chambers depending upon the type of engine. Also, in this embodiment, the balance passageway 54 is formed externally of the engine rather than in a spacer plate 52 as in the previously described embodiment. However, this type of enrichment system can be utilized in conjunction with a spacer plate formed balance passageway as described in FIGS. 2 and 3, as should be readily apparent to those skilled in the art.

In this embodiment, an enrichment device 101 is provided for supplying enrichment fuel to a T-connection 102 in the balance passage 54 through an external conduit 103. The enrichment fuel is provided in response to an engine running condition such as acceleration rather than for cold starting. Therefore, choke valves 104 are provided in the carburetors 39 for cold starting enrichment.

The enrichment device 101 includes a pump chamber 105 across which a diaphragm 106 extends to define a pumping chamber 107. Fuel is admitted to the pumping chamber 107 from one of the carburetor float bowls 49 through a conduit that includes a one-way check valve 108.

The diaphragm 106 is normally urged to an extended position by means of a coil compression spring 109 and is held in this position when the throttle valves 46 are in their closed position. The throttle link 47 bears against the diaphragm 106 and will urge the diaphragm 106 downwardly when the throttle valves 46 are opened so as to expel fuel from the pumping chamber 107 into the conduit 103 and balance passageway 54 for acceleration enrichment.

When the throttle valves 46 are again moved to their closed position, the spring 109 will be free to urge the diaphragm 106 to its extended position since the throttle link 47 will move away from the diaphragm 106 and permit this movement. A fresh charge of fuel will then be drawn into the pumping chamber 107 through the check valve 108.

Figure 6:
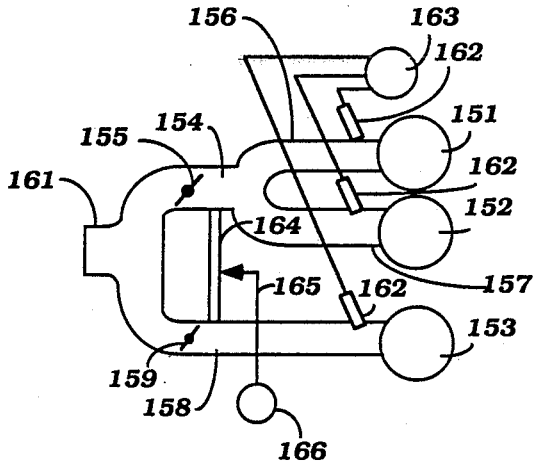
FIG. 6 is a partially schematic view showing a still further embodiment of the invention.

The two embodiments of the invention as thus far described supply additional enrichment fuel to engines that employ carburetors. However, the invention may also be practiced in conjunction with engines incorporating fuel injection systems and such an embodiment is shown in FIG. 6.

In this embodiment, the engine is shown schematically and is of the three cylinder type including three crankcase chambers 151, 152 and 153. A first intake passageway 154 has a common inlet portion in which a throttle valve 155 is positioned and then branches into a pair of passageways 156 and 157 that serve the chambers 151 and 152, respectively. A third passageway 158 serves the chamber 153 and has a single throttle valve 159 for controlling the flow through this passageway. The passageways 158 and 154 have a common inlet end 161 upstream from the throttle valves 155 and 159. It should be understood also that a single throttle valve may be employed in the common inlet 161 for all passageways.

Fuel injection nozzles 162 are provided for spraying fuel into the intake passageways 156, 157 and 158 in proximity to the crankcase chambers 151, 152 and 153. The fuel injection nozzles 162 are supplied with fuel from a fuel injection system indicated schematically at 163 and which may be of any known type.

In accordance with this embodiment, a balance passageway 164 interconnects the passageways 158 and the passageway 154 upstream of where it branches into the passageways 155 and 156 for the aforenoted purposes.

An external fuel enrichment line 165 supplies fuel to the balance passageway 164 from an enrichment device 166 that is responsive either to an ambient condition, as the embodiment of FIGS. 2 and 3, or an engine running condition.

In the embodiments as described, the enrichment fuel has been supplied in response to either starting of the engine at low temperatures or acceleration. However, enrichment fuel may be supplied for additional or other purposes such as anti-knock purposes, for cold running or any other purpose for which fuel enrichment is normally provided.

Although a number of embodiments of the invention have been illustrated and described, various changes and modifications may be made without departing from the spirit and scope of the invention, as defined by the appended claims.

We claim:

1. In a fuel enrichment system for a multi-chamber internal combustion engine comprising a first intake passage for supplying a charge to a first of said chambers, a second intake passage for supplying a charge to a second of said chambers, charge forming means for supplying a fuel/air charge to said intake passages, balance passage means for communicating said first and said second intake passages with each other, and means for introducing supplemental fuel to said balance passage means in response to a predetermined condition comprising a pump for pumping fuel under pressure and a conduit for delivering fuel from said pump to said balance passage means.

2. In a fuel enrichment system as set forth in claim 1 wherein the predetermined condition comprises a running condition of the engine.

3. In a fuel enrichment system as set forth in claim 2 wherein the running condition of the engine is an acceleration of the engine.

4. In a fuel enrichment system as set forth in claim 2 wherein the running condition of the engine is a starting condition.

5. In a fuel enrichment system as set forth in claim 1 wherein the predetermined condition is an ambient condition.

6. In a fuel enrichment system as set forth in claim 5 wherein the ambient condition is temperature.

7. In a fuel enrichment system as set forth in claim 1 further including throttle valve means for controlling the flow through the intake passages and wherein the balance passage means is disposed downstream of the throttle valve means.

8. In a fuel enrichment system as set forth in claim 1 wherein the balance passage means is formed in a spacer plate that is affixed to the engine and which defines at least in part the first and second intake passages.

9. In a fuel enrichment system as set forth in claim 1 wherein the charge forming device comprises carburetor means.

10. In a fuel enrichment system as set forth in claim 9 wherein the supplemental fuel is derived from the fuel bowl of the carburetor means.

11. In a fuel enrichment system for a multi-chamber internal combustion engine comprising a first member formed with a plurality of separate intake passages each extending to a respective one of said chambers, said first member having a face through which said intake passages open, and a second member affixed to said first member and having a plurality of passages each communicating with a respective one of said intake passages, a balance passage means within said second member for communicating at least two of said intake passages with each other, and means for introducing enrichment fuel to said balance means and comprising a pump for pumping fuel under pressure and a conduit for delivering fuel from said pump to said balance passage means.

12. In a fuel enrichment system as set forth in claim 11 wherein the second member has a face mating with the face of the first member.

13. In a fuel enrichment system as set forth in claim 12 wherein the predetermined condition is an ambient condition.

14. In a fuel enrichment system as set forth in claim 13 wherein the ambient condition is temperature.

15. In a fuel enrichment system as set forth in claim 12 wherein the means for introducing the fuel to the balance passage means introduces the fuel to the balance passage means in response to a predetermined condition for enrichment.

16. In a fuel enrichment system as set forth in claim 15 wherein the predetermined condition comprises a running condition of the engine.

17. In a fuel enrichment system as set forth in claim 16 wherein the running condition of the engine is an acceleration of the engine.

18. In a fuel enrichment system as set forth in claim 16 wherein the running condition of the engine is a starting condition.

* * * * *

UNITED STATES PATENT AND TRADEMARK OFFICE

CERTIFICATE OF CORRECTION

PATENT NO. : 4,917,053

DATED : April 17, 1990

INVENTOR(S) : Okazaki, et al

It is certified that error appears in the above-identified patent and that said Letters Patent is hereby corrected as shown below:

On the Title Page under "Foreign Application Priority Data", "1989" should be --1988--.

On the Title Page under "Foreign Application Priority Data", "64-105608" should be --63-105608--.

Abstract, line 1, "system" should be --systems--.

Signed and Sealed this

Seventeenth Day of November, 1992

*Attest:*

DOUGLAS B. COMER

*Attesting Officer*

*Acting Commissioner of Patents and Trademarks*